US006354696B1

(12) United States Patent
Isshiki

(10) Patent No.: US 6,354,696 B1
(45) Date of Patent: Mar. 12, 2002

(54) INK-JET HEAD

(75) Inventor: Kaihei Isshiki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/610,807

(22) Filed: Jul. 6, 2000

(30) Foreign Application Priority Data

Jul. 15, 1999 (JP) ..... 11-201111

(51) Int. Cl.[7] ..... B41J 2/04
(52) U.S. Cl. ..... 347/54
(58) Field of Search ..... 347/54, 68, 69, 347/70, 71, 72, 50; 394/261; 361/700; 29/890.1; 310/328–330

(56) References Cited

U.S. PATENT DOCUMENTS 6,117,698 A * 9/2000 Atobe et al. ..... 347/54

FOREIGN PATENT DOCUMENTS

| | | |
|---|---|---|
| JP | 2-51734 | 11/1990 |
| JP | 6-71882 | 3/1994 |
| JP | 61-59911 | 12/1996 |

* cited by examiner

*Primary Examiner*—Raquel Yvette Gordon
(74) *Attorney, Agent, or Firm*—Cooper & Dunham LLP

(57) ABSTRACT

An ink-jet head includes nozzle holes for firing ink drops, ink flow paths with which the nozzle holes communicate, vibration plates which are walls of the ink flow paths, and electrodes facing the vibration plates, and firing the ink drops from the nozzle holes as a result of the vibration plates being deformed by electrostatic forces between the vibration plates and electrodes. The electrodes are provided on an electrode substrate having conductivity with an insulating layer provided therebetween, and the electrode substrate and the vibration plates are electrically connected together.

10 Claims, 8 Drawing Sheets

INK-JET HEAD

BACKGROUND OF THE INVENTION

1. Field of the Invention

The present invention generally relates to an ink-jet head, and, in particular, to an electrostatic ink-jet head.

2. Description of the Related Art

An ink-jet head used in an ink-jet recording apparatus used as an image recording apparatus (image forming apparatus) such as a printer, a facsimile machine, a copier, a plotter or the like includes nozzle holes through which ink drops are fired, firing chambers (also called pressure chambers, pressurizing liquid chambers, liquid chambers, ink flow paths or the like) with which the nozzle holes communicate, and energy generating mechanisms which generate energy for pressurizing the ink in the discharge chambers. As a result of the energy generating mechanisms being driven, the ink in the discharge chambers is pressurized, and ink drops are fired therefrom through the nozzle holes. An ink-on-demand system in which ink drops are fired only at a time of recording is mainly employed.

In the related art, as the energy generating mechanisms which generate energy for pressurizing the ink in the firing chambers, one in which vibration plates as walls of the firing chambers are deformed through piezoelectric devices, and the volumes of the firing chambers are changed, and ink drops are fired therefrom (see Japanese Patent Publication No. 2-51734), or one in which ink is heated in the firing chambers through heating resistance elements, bubbles are generated, thereby the pressures in the chambers are increased, and ink drops are fired therefrom (see Japanese Patent Publication No. 61-59911) are known.

In the former system in which the piezoelectric devices are used, a process of sticking chips of the piezoelectric devices to the vibration plates for generating pressures in the firing chambers is complicated, and, also, it is not possible to greatly improve printing speed and printing quality. In the latter system in which ink is heated, although the problems involved in the system using the piezoelectric devices do not occur, the heating resistance elements are damaged due to repetition of rapid heating and cooling, and a shock at a time when bubbles burst. Thereby, the life of the ink-jet head is short in general.

In order to solve these problems, as disclosed in Japanese Laid-Open Patent Application No. 6-71882 and so forth, an ink-jet head is proposed in which vibration plates as walls of the firing chambers and electrodes are arranged in parallel (gaps formed therebetween being referred to as 'parallel gaps'), the vibration plates are deformed by electrostatic forces generated between the vibration plates and electrodes, thereby the volumes of the firing chambers are changed, and ink drops are fired therefrom.

Such an electrostatic ink-jet head in the related art has, as shown in FIGS. 1 and 2, a substrate 101 which includes pressurizing chambers 102, vibration plates 103 as walls of the pressurizing chamber 102, a common ink chamber 104 which supplies ink to the pressurizing chambers 102, an ink supply path 105 through which the common ink chamber 104 and pressurizing chambers 102 communicate, and so forth. Further, in this ink-jet head, silicon oxide films 112 are formed on an electrode substrate 111 of a borosilicate-glass substrate or a silicon substrate, electrodes 113 facing the vibration plates 103 are formed on the silicon oxide films 112, and the surfaces of the electrodes 112 are covered by insulating films 114. Then, the substrate 101 and electrode substrate 111 are bonded together with the silicon oxide films 112 provided therebetween. Further, a nozzle plate 121 is bonded onto the substrate 101, and has nozzle holes 122 which communicate with the pressurizing chambers 102 and an ink supply hole 123 which supplies ink to the common ink chamber 104 formed therein.

Further, in order to use the vibration plates 103 as a common electrode, as shown in FIG. 1, an electrode-connecting area 106 for the common electrode is provided in the substrate 101 at an end thereof in a nozzle-arranged direction, and, in order to use the electrodes 113 as individual electrodes, the electrodes 113 are extended to the end of the electrode substrate 111, and electrode pads 116 are formed. A portion of the substrate 101 is removed above the electrode pads 116.

In the above-described electrostatic ink-jet head in the related art, it is necessary to provide the electrode-connecting area so as to use the vibration plates as the common electrode. Thereby, the area of the head increases. Further, because the gaps between the vibration plates and electrodes are formed using the silicon oxide films as gap spacers as they are, it is difficult to control the gaps through a wide range, and to make design suitable for desired operation (vibration) characteristics of the head.

SUMMARY OF THE INVENTION

The present invention has been devised in consideration of the above-mentioned matters, and, an object of the present invention is to miniaturize an ink-jet head and to reduce a variation in vibration characteristics of the ink-jet head.

In order to solve the above-mentioned problems, in an ink-jet head according to the present invention, electrodes facing vibration plates are provided on an electrode substrate having conductivity with an insulating layer provided therebetween, and the electrode substrate and vibration plates are electrically connected together.

Thereby, it is possible to use the electrode substrate as a common electrode, to miniaturize the head, and to reduce variation in ink-drop-firing characteristics among bits.

Here, the electrical connection of the electrode substrate and vibration plates may be made as a result of the electrode substrate being bonded to the vibration plates without an insulating layer provided therebetween. Thereby, it is possible to electrically connect the electrode substrate and vibration plates together stably with high reliability. In this case, the electrode substrate and vibration plates may be formed from silicon substrates, and both the silicon substrates may be bonded together directly. Thereby, a warp and/or coming off due to a difference in thermal expansion coefficient does not take place therein, and the gap accuracy can be secured. Alternatively, the electrode substrate and vibration plates may be formed from silicon substrates, and both the silicon substrates may be bounded together by eutectic bonding through a metal. Thereby, the gap accuracy can be secured, and, also, the resistance of the vibration plates is reduced.

In this case, it is preferable to use a single-crystal silicon substrate having a crystal plane orientation (100) as the electrode substrate. Thereby, it is possible to improve design flexibility in gap formation using anisotropic etching, and, also, to easily form variable gaps (gaps having variable gap lengths).

Further, it is also preferable to use a single-crystal silicon substrate having a crystal plane orientation (110) as the electrode substrate. Thereby, it is possible to improve design flexibility in gap formation using anisotropic etching, and, also, to obtain stable vibration characteristics.

Other objects and further features of the present invention will become more apparent from the following detailed description when read in conjunction with the accompanying drawings.

DETAILED DESCRIPTION OF THE PREFERRED EMBODIMENTS

Figure 1:
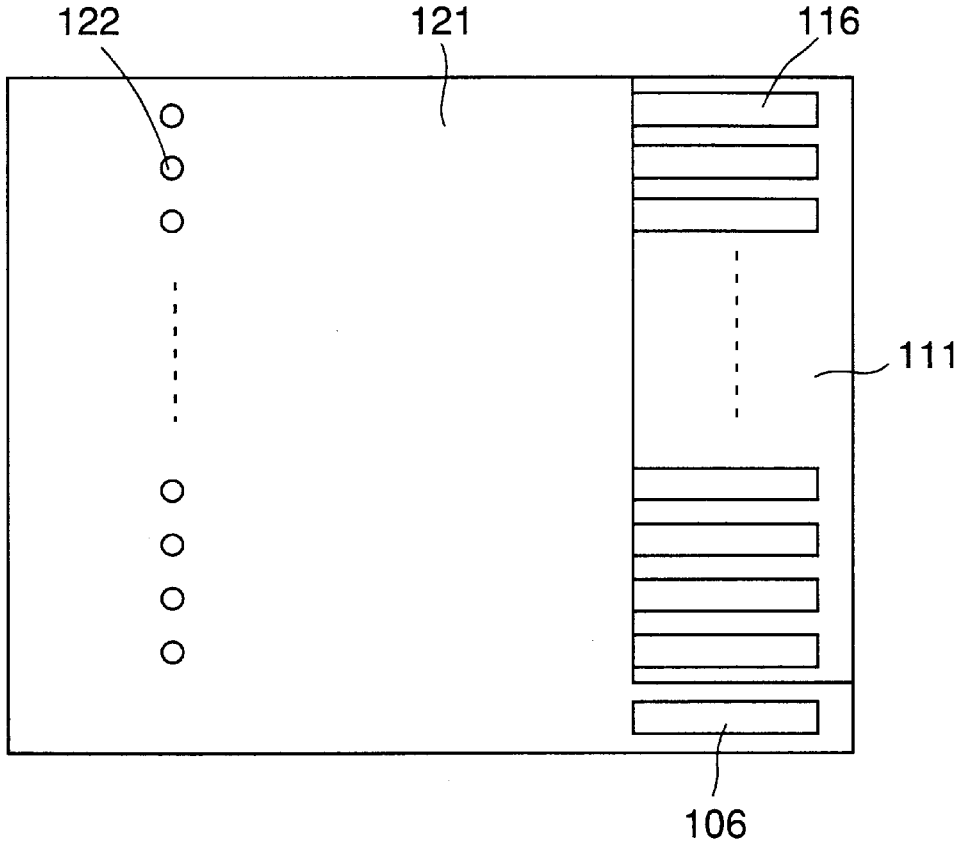
FIG. 1 shows a plan view of an ink-jet head in the related art.
Figure 2:
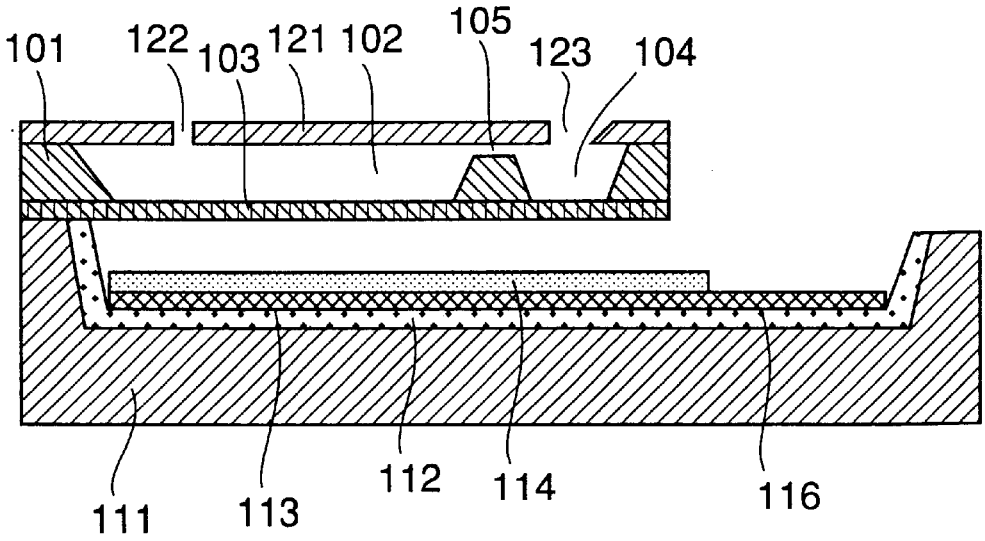
FIG. 2 shows an elevational sectional view of the head shown in FIG. 1 taken along a long-side direction.
Figure 3:
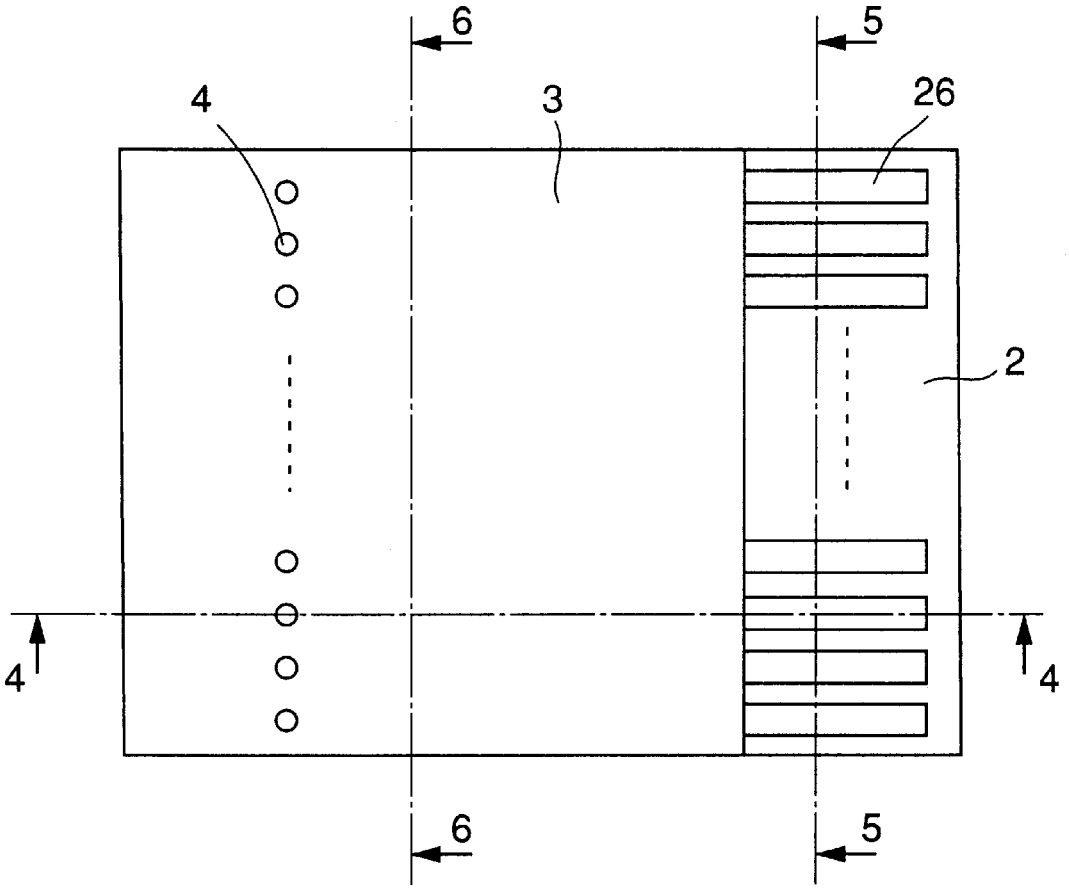
FIG. 3 shows a plan view of an ink-jet head in a first embodiment of the present invention.
Figure 4:
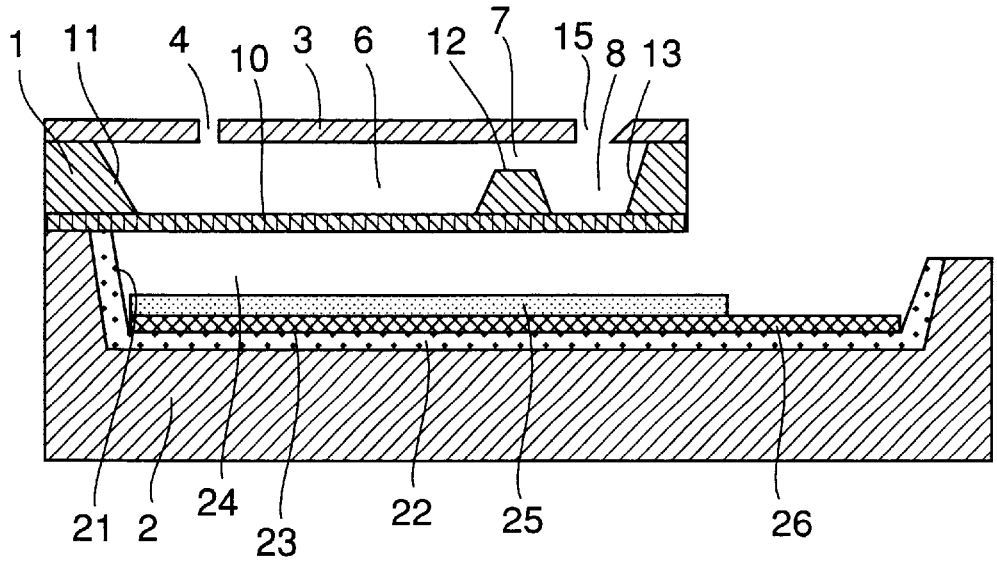
FIG. 4 shows an elevational sectional view of the head shown in FIG. 3 taken along a 4—4 line.
Figure 5:
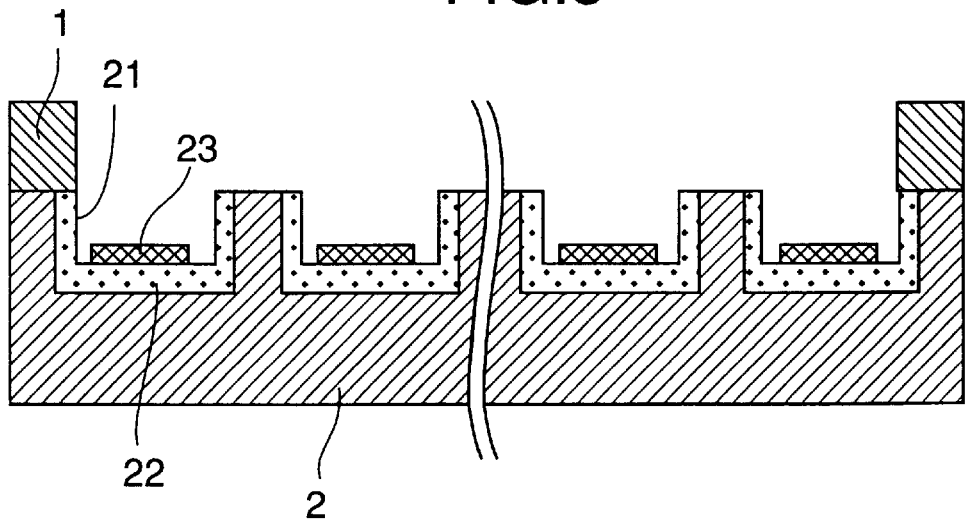
FIG. 5 shows an elevational sectional view of the head shown in FIG. 3 taken along a 5—5 line.
Figure 6:
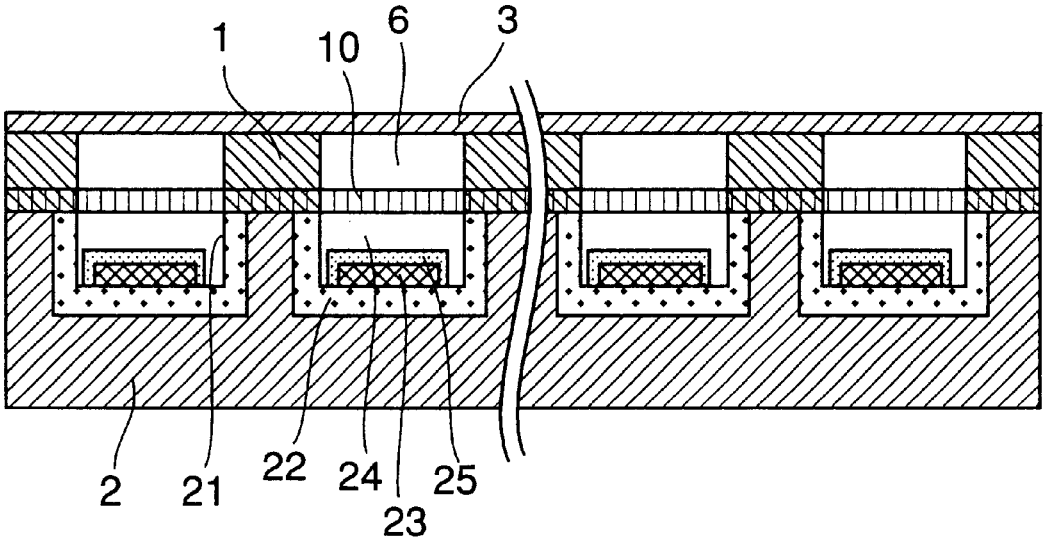
FIG. 6 shows an elevational sectional view of the head shown in FIG. 3 taken along a 6—6 line.

Embodiments of the present invention will now be described making reference to figures. FIG. 3 is a plane view of an ink-jet head in a first embodiment of the present invention, FIG. 4 is a side elevational sectional view of the ink-jet head taken along the 4—4 line of FIG. 3, FIG. 5 is a rear elevational sectional view of the ink-jet head taken along the 5—5 line of FIG. 3, and FIG. 6 is a rear elevational sectional view of the ink-jet head taken along the 6—6 line of FIG. 3.

This ink-jet head includes a vibration-plate/liquid-chamber substrate 1, an electrode substrate 2 provided below the vibration-plate/liquid-chamber substrate 1, and a nozzle plate 3 provided above the vibration-plate/liquid-chamber substrate 1. The ink-jet head has a plurality of nozzle holes 4 through which ink drops are fired, pressurizing chambers 6 which are ink flow paths with which the respective nozzle holes 4 communicate, a common ink chamber 8 which communicates with the respective pressurizing chambers 6 through fluid resistance portions 7 which also act as ink supply paths.

The vibration-plate/liquid-chamber substrate 1 is a silicon substrate such as, for example, a single-crystal silicon substrate, a polycrystalline silicon substrate or an SOI substrate, and has recess portions 11 which is used for the pressurizing chambers 6 and vibration plates (first electrodes) 10 (which are bottom walls of the pressurizing chambers 6), respectively, grooves 12 which is used for the fluid resistance portions 7, respectively, and a recess portion 13 which is used for the common ink chamber 8 formed therein.

The electrode substrate 2 is a substrate having a conductivity (a silicon substrate having a conduction type the same as that of the vibration plates, in this embodiment), has recess portions 21 formed therein. Silicon oxide films 22 which are insulating films (insulating layers) are formed on surfaces of the recess portions 21, respectively. Then, electrodes 23 facing the vibration plates 10, respectively, are formed on bottom surfaces of the recess portions 21 with the silicon oxide films 22 provided therebetween, respectively. Thus, the electrodes 23 are provided in the electrode substrate 2 with the insulating layers 22 provided therebetween, respectively, and gaps 24 are formed between the vibration plates 10 and electrodes 23, respectively. Actuator portions are formed by the vibration plates 10 and electrodes 23, respectively. On the surfaces of the electrodes 23, insulating films (protecting films) 25 which are oxide films such as $SiO_2$ films, nitride films or the like are formed, and electrode pads 26 are formed as a result of the electrodes 23 being extended, respectively.

In this embodiment, a single-crystal silicon substrate having a crystal plane orientation (110) is used as the electrode substrate 2. Thereby, it is possible to form the recess portions 21 having vertical walls (walls along a long-side direction), respectively, by anisotropic etching through wet etching. As a result of the electrodes 23 being formed on these recess portions 21, respectively, it is possible to widen areas of the electrodes facing the vibration plates 10, respectively, to increase electric capacities, and to obtain stable vibration characteristics.

These vibration-plate/liquid-chamber substrate 1 and electrode substrate 2 are single-crystal silicon substrates, both the substrates 1 and 2 are bonded together directly or by eutectic bonding through a metal, and, as shown in FIG. 4, the electrode substrate 2 and vibration plates 10 are bonded without an insulating layer provided therebetween and are electrically connected together.

In the nozzle plate 3, as well as the plurality of nozzle holes 4, an ink supply hole 15 is formed for enabling ink to be supplied to the common ink chamber 8 externally. On the ink firing surface of the nozzle plate 3, a surface treatment layer having a water-repellent property is formed.

In the above-described ink-jet head, because the vibration plates 10 are electrically connected with the electrode substrate 2 which is a substrate having conductivity without an insulating layer provided therebetween, the electric potential of the vibration plates 10 is on the ground level (0 V) as a result of the electrode substrate 2 being grounded. Thereby, it is possible to use the vibration plates 10 as a common electrode. Then, as a result of driving voltages being applied between the electrodes 23 which are individual electrodes and the vibration plates 10, respectively, the vibration plates 10 is deformed thereby, the volumes of the respective pressurizing chambers 6 change, and ink drops are fired through the nozzle holes 4.

In this case, as a method of driving and deforming the vibration plates, either a non-contact driving method in which the vibration plates 10 are deformed to approach but not to come into contact with the electrodes 23, respectively, then, in this condition, electricity is discharged so that the vibration plates 10 return to the original positions, and, thereby, ink drops are fired, or a contact driving method in which the vibration plates 10 are deformed to approach so as to come into contact with the electrodes 23, respectively, then, in this condition, electricity is discharged so that the vibration plates 10 return to the original positions, and, thereby, ink drops are fired may be employed.

Thus, the electrodes are provided on the electrode substrate having conductivity with the insulating film provided therebetween, and the electrode substrate is bonded to the vibration plates without an insulating film provided therebetween and thus is electrically connected thereto. Thereby, it is possible to omit the electrode-connecting area for using the vibration-plate substrate as the common electrode, and to miniaturize the ink-jet head. Further, because it is possible to apply the electric potential for the common electrode through the wide area of the rear surface of the electrode substrate, it is possible to reduce variation in ink-firing characteristics due to variation in electric potentials among bits (among the nozzles).

Further, as a result of the electrical connection between the electrode substrate and vibration plates being made by bonding the electrode substrate and vibration plates together without an insulating layer provided therebetween, it is possible to obtain a stable electric connection with high reliability. However, it is also possible to bond the electrode substrate and vibration plates together with an insulating layer provided therebetween and to electrically connect the electrode substrate and vibration plates together by a different method.

Figure 7:
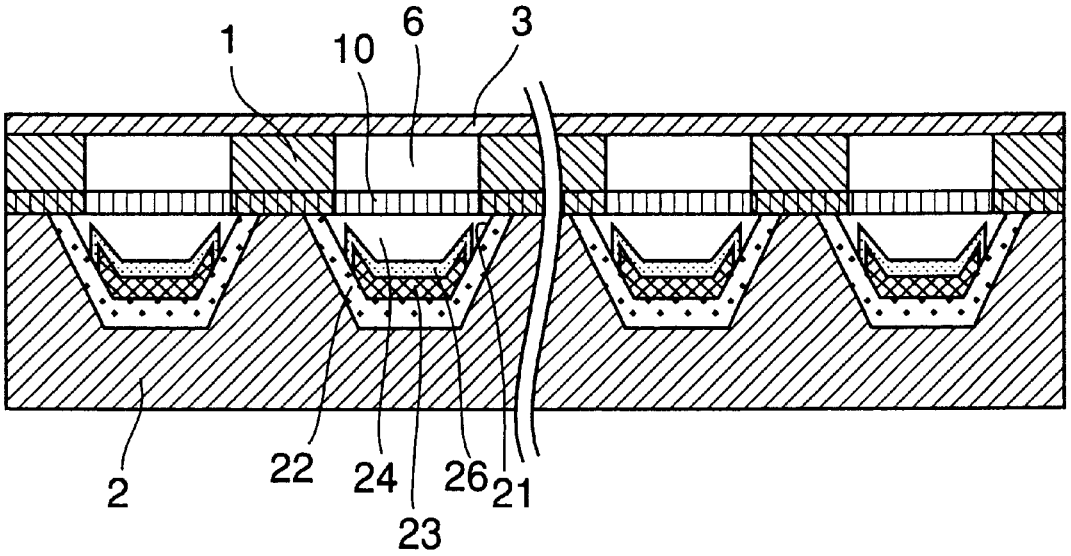
FIG. 7 shows an elevational sectional view of an ink-jet head in a second embodiment of the present invention, corresponding to the view shown in FIG. 6.

An ink-jet head in a second embodiment of the present invention will now be described making reference to FIG. 7.

In forming this ink-jet head, a silicon substrate having a crystal plane orientation (100) is used as the electrode substrate 2, and the recess portions 21 are formed by anisotropic etching through wet etching.

In this case, because each recess portion 21 has walls inclined approximately 54 degrees, a depth of each gap 24 gradually changes as a result of the electrode 23 being formed in the recess portion 21, as shown in the figure. The gap formed between the vibration plate and the electrode which are not parallel to one another is referred to as a 'non-parallel gap'.

An electrostatic force produced between each of the vibration plates 10 and a respective one of the electrodes 23 is inverse proportion to the square of a space (distance) therebetween. Therefore, it is possible to obtain a desired electrostatic force by a lower voltage when a distance therebetween is smaller. Accordingly, as a result of the depth of each gap 24 changing gradually as mentioned above, each vibration plate 10 is deformed from portions at which the distances from the respective electrode 23 are small, and, then, in response thereto, the distance between the vibration plate 10 and electrode 23 becomes smaller. Thereby, it is possible to drive the vibration plate 10 by a lower driving voltage.

An ink-jet head in a third embodiment of the present invention and a manufacturing method thereof will now be described making reference to FIGS. 8A through 11. FIGS. 8A through 8E and 9A through 9C show elevational sectional views taken along a head-long-side (longitudinal) direction. FIGS. 10A through 10E and 11A through 11C show elevational sectional views taken along a head-short-side (width) direction.

Figure 8A:
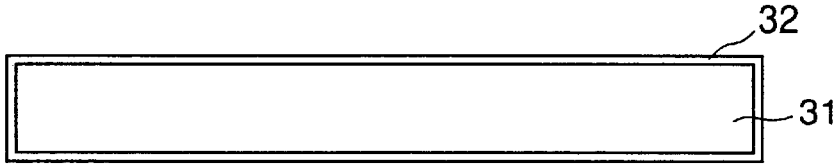
FIGS. 8A through 8E show elevational sectional views of an ink-jet head in a third embodiment of the present invention taken along a head-long-side direction for illustrating manufacturing processes thereof.
Figure 10A:
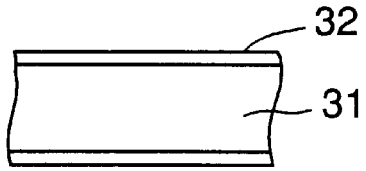
FIGS. 10A through 10E show elevational sectional views of the ink-jet head in the third embodiment of the present invention taken along a head-short-side direction for illustrating the manufacturing processes thereof the same as those of FIGS. 8A through 8E.

As shown in FIGS. 8A and 10A, a silicon oxide film 32 having a thickness of approximately 50 nm and becoming a protecting film is formed, by a thermal oxidation method, on the surface of a p-type single-crystal substrate 31 having a crystal plane orientation (110) or (100) and becoming the electrode substrate 2. In this embodiment, the p-type single-crystal silicon substrate inexpensive is used. However, instead, an n-type silicon substrate may also be used. However, an arrangement should be made such that the silicon substrate 31 becoming the electrode substrate 2 and the vibration plates 10 have the same conduction type.

Figure 8B:
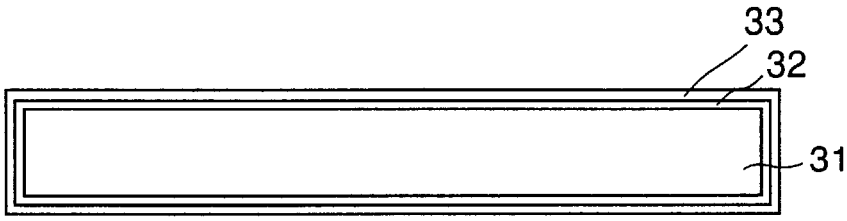
Figure 8C:
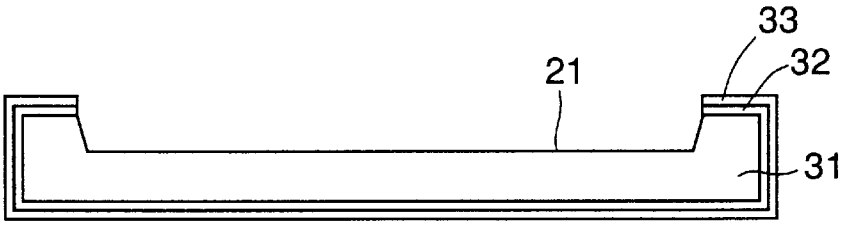
Figure 10B:
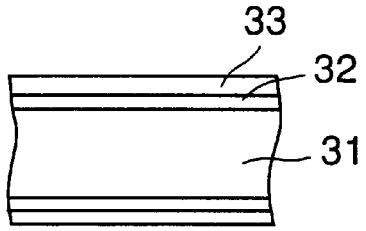
Figure 10C:
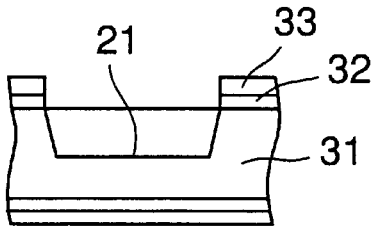

Then, as shown in FIGS. 8B and 10B, on the silicon oxide film 32, a silicon nitride film 33, which will be used as an etching barrier layer in a subsequent process, having a thickness of approximately 100 nm is formed by LP-CVD, thermal CVD or the like. Then, as shown in FIGS. 8C and 10C, in accordance with a photoetching process, a pattern is formed for forming electrodes, a photoresist film is used as a mask, and the silicon nitride film 33 and silicon oxide film 32 are etched in sequence, and a pattern having a shape such that portions in which the electrodes 23 will be formed are removed is formed.

Then, the thus-obtained substrate 31 is immersed in a high-concentration solution of potassium hydroxide (for example, KOH solution having a concentration of 30%, heated to 80° C.), anisotropic etching of silicon is thus performed, and, thereby, the recess portions 21 desired are engraved in the silicon substrate 31. The depth the thus-obtained recess portions 21 is to the amount of the gap depth needed for driving the vibration plates 10, respectively, the thickness of the electrode protecting films 25, the thickness of the electrodes 23, and the thickness of the silicon oxide films 22 for insulating the electrodes 23 from the silicon substrate 31.

In this case, the etching is performed using the high-concentration solution of alkali metal. However, instead, wet etching using TMAH (TetraMethyl AmmoniumHydroxide) or the like may be employed. Further, although a time is required, it is also possible to form the recess portions 21 by dry etching. However, in the case of dry etching, it is not possible to perform gap control utilizing anisotropicity of etching rate as in the above-described second embodiment.

Figure 8D:
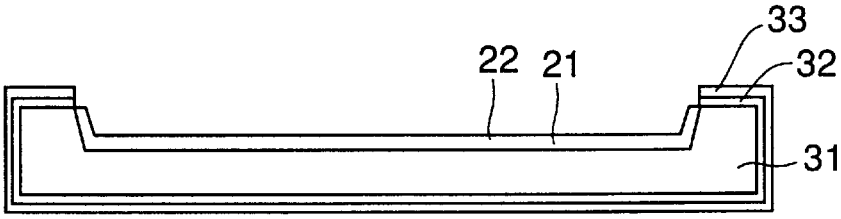
Figure 10D:
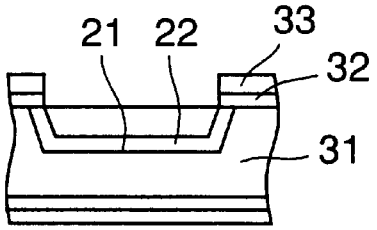

Then, after the silicon substrate 31 having the recess portions 21 formed therein is cleaned, as shown in FIGS. 8D and 10D, heat treatment is performed on the entirety of the silicon substrate 31, and, thus, the silicon oxide films 22 which act as the insulating films are formed in the recess portions 21, respectively, at which silicon is bared. The thickness of these silicon oxide films 22 is such that the individual electrodes 23 can be electrically insulated from the silicon substrate 31. In this case, assuming that connection is made to the individual electrodes 23 by wire bonding, the silicon oxide films 22 having a thickness of approximately 1 $\mu$m are formed. At the time of forming the silicon oxide films 22, because the silicon nitride film 33 remains on the surface of the silicon substrate 31 onto which a silicon substrate becoming the vibration-plate/liquid-chamber substrate will be bonded, the silicon oxide film 32 does not grow there, and is maintained in a thin condition.

Figure 8E:
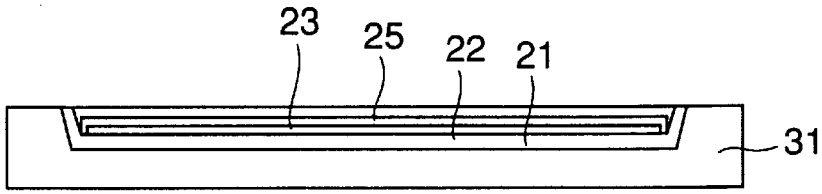
Figure 10E:
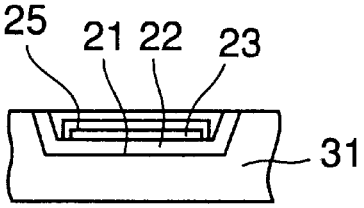

Then, as shown in FIGS. 8E and 10E, a polycrystalline silicon film having a thickness of approximately 300 nm and being the material of the electrodes 23 is deposited, and, using a method of photoetching, the deposited film is shaped to a desired shape such that the electrodes 23 are formed. In this case, the polycrystalline silicon doped with impurities is used as the material of the electrodes. However, instead, it is also possible to use a high-melting-point metal as the material of the electrodes. Further, conductive ceramics such as titanium nitride may be used as the material of the electrodes.

Then, thermal oxidation of the thus-obtained silicon substrate is performed, thus the oxide films 25 are formed on the polycrystalline-silicon electrodes 23, respectively, and are used as films for protecting the electrodes 23. In the case where the titanium nitride is used as the material of the electrodes, after the material of the electrodes is deposited, a silicon oxide film such as HTO is deposited, a shape of the electrodes is formed thereon by photoetching, the thus-obtained pattern is used as a mask and etching is performed to the material of the electrodes in sequence, and thus the electrodes 23 are formed.

Then, although not shown in the figures, the silicon nitride film 33 remaining on the silicon substrate 31 is selectively removed by etching. After the nitride film 33 is removed, the silicon oxide film 32 on the surface of the silicon substrate 31 is completely removed using dilute hydrofluoric acid. At this time, the silicon oxide films 25 on the electrodes 23 are also eroded. However, there is no problem because the silicon oxide films 25 are sufficiently thicker than the oxide film 32 on the silicon substrate 1 on which the silicon substrate becoming the vibration-plate/liquid-chamber substrate will be bonded. However, a natural oxide film will be formed on the silicon substrate 31, soon, from which the oxide film 32 has been removed. Therefore, it is important to remove the oxide film 32 immediately before the silicon substrate which becomes the vibration-plate/liquid-chamber substrate is bonded to the silicon substrate 31.

Figure 9A:
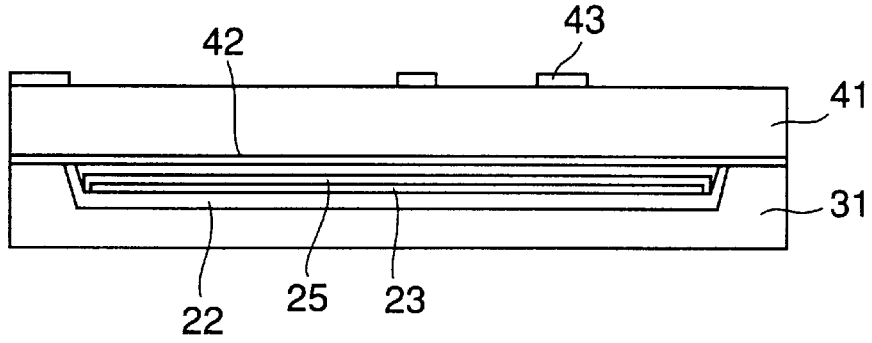
FIGS. 9A through 9C show elevational sectional views of the ink-jet head in the third embodiment of the present invention taken along the head-long-side direction for illustrating manufacturing processes thereof subsequent to those of FIGS. 8A through 8E.
Figure 11A:
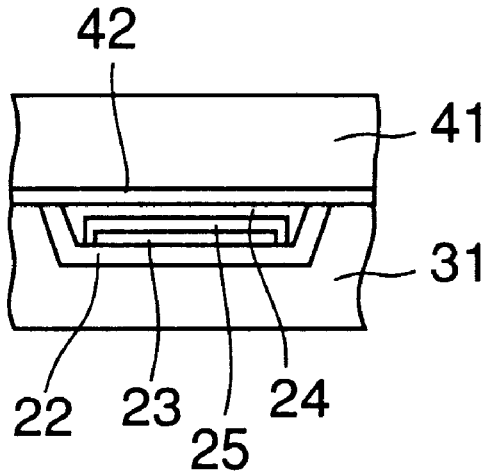
FIGS. 11A through 11C show elevational sectional views of the ink-jet head in the third embodiment of the present invention taken along the head-short-side direction for illustrating the manufacturing processes thereof subsequent to those of FIGS. 10A through 10E and the same as those of FIGS. 9A through 9C.

Thus, after the oxide film 32 is removed from the silicon substrate 31, as shown in FIGS. 9A and 11A, the silicon substrate 41 which becomes the vibration-plate/liquid-chamber 1 is bonded to the silicon substrate 31.

In this case, a p-type, both-side-polished silicon substrate having a crystal plane orientation (110) is used as the silicon substrate 41. The reason why such a silicon substrate is used is that, anisotropicity of etching rate at a time of wet etching of silicon is utilized, and, thereby, a high-accuracy worked shape will be obtained.

From the surface of the silicon substrate 41, which surface is bonded to the silicon substrate 31, a high concentration (equal to or higher than $1\times10^{20}$ atoms/cm$^3$) of boron is implanted, then is activated, and is diffused to a predetermined depth, that is, the thickness of the vibration plates 10, and, thus, a boron-diffused layer 42 is formed. In this case, the silicon substrate having the impurities implanted thereinto is employed. However, instead, it is also possible to use an active layer of an SOI substrate as the vibration plates 10. Further, it is also possible to employ a substrate obtained as a result of silicon growing by epitaxy on the above-mentioned high-concentration-impurity substrate. Any substrate can be used as long as a conduction type of the vibration plates and a conduction type of the electrode substrate are the same as one another.

The bonding of the silicon substrate 31 and silicon substrate 41 together will now be described. First, both the substrates 31 and 41 are cleaned by an SC-1 cleaning method (cleaning in a solution obtained as a result of a mixture of an ammonia solution, a hydrogen peroxide solution and an ultra pure water being heated to a temperature equal to or higher than 80° C.). Then, they are cleaned by a dilute hydrofluoric acid, and the oxide films of the silicon substrates 31 and 41 are removed. By this process, not only the oxide films on the surfaces are completely removed, but also the silicon interfaces are terminated by hydrogen atoms. Thereby, the surfaces of both the silicon substrates 31 and 41, which surfaces will be bonded together, have water-repellent property. By this process, conductivity of the silicon surfaces can be secured.

Then, the surfaces of the respective substrates 31 and 41 are aligned quietly, and are bonded together. At this time, bonding of both the substrates 31 and 41 merely has a weak self bonding force such as an inter-molecule force. Therefore, they are temporality fixed to one another as a result of being pressed together by a pressure of 1 to 2 bars. Then, in a nitrogen atmosphere, both the substrates 31 and 41 are baked at 800 to 1100° C. (in this case, 1000° C.) for a time on the order of two hours. Thereby, both the substrates 31 and 41 can be bonded together directly. By this heat treatment, both the substrates 31 and 41 are fixed to one another firmly, and thus, a necessary bonding strength can be obtained.

Then, in the silicon substrate 41 which has been bonded to the substrate 31, the thin vibration plates 10 and recess portions for liquid chambers are formed. First, a silicon nitride film 43 having a thickness of approximately 500 nm is formed on the bonded silicon substrate 41 by LP-CVD, thermal CVD or the like. The thickness of the silicon nitride film 43 at this time should be such that the film can act as a mask at a time of etching in a subsequent process.

Then, photoresist is coated on the silicon substrate 41 in which the vibration plates will be formed, infrared light or the like is used, a pattern aligned with the pattern of the electrodes in the bonded substrate 31 is formed from the photoresist, the silicon nitride film 43 are partially removed in accordance with this photoresist pattern, and a pattern of the silicon nitride film 43 having openings corresponding to the recess portions for the pressurizing chambers and recess portion for the common ink chamber is formed.

Figure 9B:
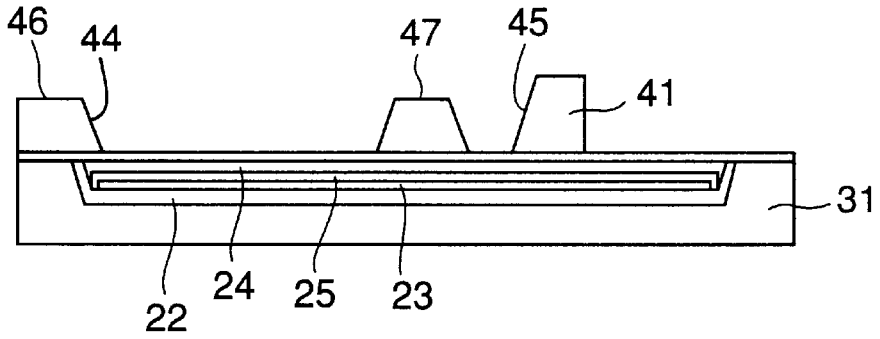
Figure 11B:
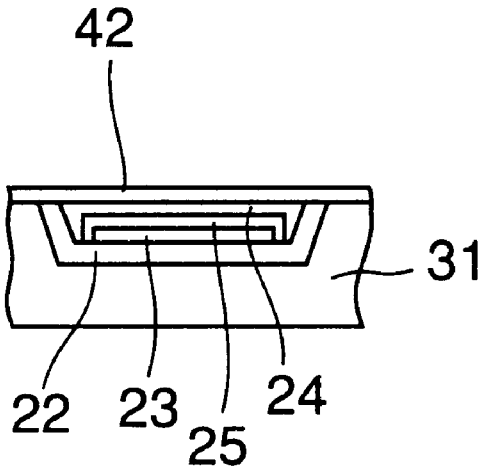

Then, the silicon substrates 31 and 41 bonded together are immersed in a high-concentration solution of potassium hydroxide (for example, KOH solution having a concentration of 30%, heated to 80° C.), as shown in FIGS. 9B and 11B, anisotropic etching of the silicon substrate 41 is thus performed, thereby recess portions 44 which become the pressurizing chambers 6 having a desired shape and a recess portion 45 which becomes the common ink chamber 8 having a desired shape are formed. Further, grooves (orifices) 46 which become nozzle-communication paths 4*a* and grooves 47 which become the fluid resistance portions 7 are formed.

At this time, as a result of the silicon nitride film 43 being formed by CVD, the silicon nitride film 43 is formed on the entire surface of the silicon substrate 41. Thereby, although the silicon substrate 41 is immersed in the solution of potassium hydroxide, the surface other than the surface on which the predetermined pattern are formed is not eroded. Then, when the etching reaches the diffused layer 42 in which the impurities are diffused to the high concentration, the etching rate is lowered so that the etching almost stops. Thereby, it is possible to obtain the vibration plates 10 having a desired thickness made from the diffused layer 42 with high accuracy. This enables less-strict determination of conditions such as those of management of etching time and so forth, and, thereby, a process management can be easily performed.

Figure 9C:
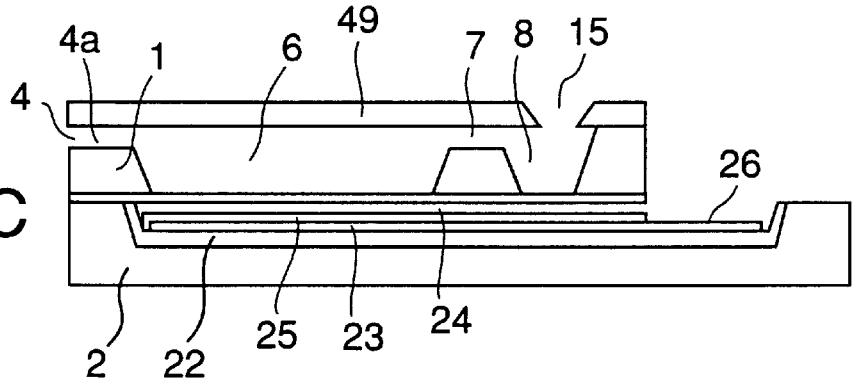
Figure 11C:
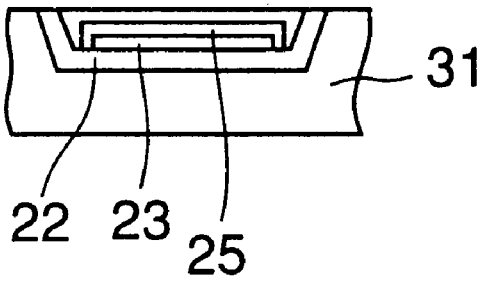

Then, the silicon substrates 31 and 41 having undergone the etching are cleaned, and, if necessary, the silicon nitride film remaining on the bonded substrates 31 and 41 is selectively removed. Then, as shown in FIGS. 9C and 11C, a portion of the silicon substrate 41, through which portion electrical connection will be made to the individual electrodes, is removed so as to be an opening, using an etching mask. Then, the thus-obtained combination is cut into individual ink-jet heads. Then, a lid member 49 having the ink supply hole 15 is stuck onto the silicon substrate 41.

Thereby, as shown in FIGS. 9C and 11C, the vibration-plate/liquid-chamber substrate 1 is formed from the silicon substrate 41, the electrode substrate 2 is formed from the silicon substrate 31, and, the ink-jet head having the nozzle holes 4 on the end surface thereof, the pressurizing chambers 6 with which the nozzle holes 4 communicate through the nozzle-communicating paths 4*a,* respectively, the vibration plates 10 which are bottom walls of the respective pressurizing chambers 6, and the electrodes 23 facing the respective vibration plates 10, and so forth, is completed.

Then, the individual electrodes 23 of the ink-jet head are connected to a support substrate (a mounting substrate such as a glass epoxy substrate or the like) by wire bonding, and connection is made to the reverse side of the silicon substrate 31 which is the electrode substrate 2 used as the common electrode.

By making such an arrangement, it is possible to stably supply the electric potential of the vibration plates, and, also, to control variation in vibration characteristics among respective bits.

Another manufacturing method of the ink-jet head in the third embodiment of the present invention will now be described.

In this method, the above-described silicon substrate 41 which becomes the vibration-plate/liquid-chamber substrate and silicon substrate 31 which becomes the electrode substrate are bonded together by eutectic bonding. The others are the same as those of the above-described manufacturing method, and descriptions thereof will be omitted.

Specifically, first, both the substrates 31 and 41 are cleaned by an SC-1 cleaning method (cleaning in a solution obtained as a result of a mixture of an ammonia solution, a hydrogen peroxide solution and an ultra pure water being heated to a temperature equal to or higher than 80° C.). Then, they are cleaned by a dilute hydrofluoric acid, and the oxide films of the silicon substrates 31 and 41 are removed. By this process, not only the oxide films on the surfaces are completely removed, but also the silicon interfaces are terminated by hydrogen atoms. Thereby, the surfaces of both the silicon substrates 31 and 41, which surfaces will be bonded together, have water-repellent property. By this process, conductivity of the silicon surfaces can be secured.

Then, on the surface of the silicon substrate 41, which surface will be bonded to the silicon substrate 31, gold which is a metal by which eutectic reaction takes place with silicon is deposited to have a thickness of approximately 1 $\mu$m. Although gold is used in this case, any other metal by which eutectic reaction takes place with silicon, such as Sn, Pb, an alloy of Ge and gold or the like, for example, can also be used.

Then, after the silicon substrates 41 and 31 are joined together and are fixed by a fixing jig, they are baked in nitrogen atmosphere at 400° C. for one hour, and, thus, the wafers are stuck together. By this heat treatment, eutectic reaction of the gold and silicon takes place, and the gold and silicon form a liquid layer at a low temperature on the order of 370° C., and enter an eutectic state. When silicon is diffused further, a range of composition in which eutectic reaction takes place is exited from, then a liquid layer cannot be formed at such a low temperature, and the reaction stops. Thereby, the silicon substrate 31 and silicon substrate 41 are united, and, thus, firm bonding thereof can be obtained.

The present invention is not limited to the above-described embodiments, and variations and modifications may be made without departing from the scope of the present invention.

The present application is based on Japanese priority application No. 11-201111, filed on Jul. 15, 1999, the entire contents of which are hereby incorporated by reference.

What is claimed is:

1. An ink-jet head comprising nozzle holes for firing ink drops, ink flow paths with which said nozzle holes communicate, vibration plates which are walls of said ink flow paths, and electrodes facing said vibration plates, and firing the ink drops from said nozzle holes as a result of the vibration plates being deformed by electrostatic forces between said vibration plates and electrodes, wherein:

said electrodes are provided on an electrode substrate having conductivity, an insulating layer being provided between said electrodes and said electrode substrate; and said electrode substrate and said vibration plates are electrically connected together.

2. The ink-jet head as claimed in claim 1, wherein said electrode substrate and said vibration plates are bonded together without an insulating layer provided therebetween.

3. The Ink-jet head as claimed in claim 2, wherein said electrode substrate and said vibration plates are formed from silicon substrates, and, also, both said silicon substrates are bonded together by eutectic bonding through a metal.

4. The ink-jet head as claimed in claim 3, wherein said electrode substrate is a single-crystal silicon substrate having a crystal plane orientation (100).

5. The Ink-jet head as claimed in claim 3, wherein said electrode substrate is a single-crystal silicon substrate having a crystal plane orientation (110).

6. The ink-jet head as claimed in claim 2, wherein said electrode substrate and said vibration plates are formed from silicon substrates, and, also, both said silicon substrates are bonded together directly.

7. The ink-jet head as claimed in claim 6, wherein said electrode substrate is a single-crystal silicon substrate having a crystal plane orientation (100).

8. The ink-jet head as claimed in claim 6, wherein said electrode substrate is a single-crystal silicon substrate having a crystal plane orientation (110).

9. An ink-jet head comprising:

a conductive electrode substrate;

ink flow paths having walls and communicating with nozzle holes through which ink drops are ejected;

vibration plates which form at least a part of the walls forming said ink flow paths; and electrodes facing said vibration plates for ejecting ink drops from said nozzle holes as a result of the vibration plates being deformed by electrostatic forces between said vibration plates and electrodes, said electrodes being provided on said conductive electrode substrate, an insulating layer being provided between said electrodes and said conductive electrode substrate, said conductive electrode substrate and said vibration plates being electrically connected together.

10. An ink-jet head comprising:

a conductive electrode substrate;

an insulating layer provided on the conductive electrode substrate;

electrodes provided on the insulating layer;

ink flow paths having walls and communicating with nozzle holes through which ink drops are ejected;

vibration plates which form at least a part of the walls forming said ink flow paths, the vibration plates for ejecting ink drops from said nozzle holes as a result of the vibration plates being deformed by electrostatic forces between said vibration plates and electrodes, said conductive electrode substrate and said vibration plates being electrically connected together.

* * * * *